US010102993B2

(12) United States Patent
Guignot

(10) Patent No.: US 10,102,993 B2
(45) Date of Patent: Oct. 16, 2018

(54) CONTACT DEVICE OF A STARTER CONTACTOR

(71) Applicant: VALEO EQUIPEMENTS ELECTRIQUES MOTEUR, Creteil (FR)

(72) Inventor: Romain Guignot, St Victor de Cessieu (FR)

(73) Assignee: Valeo Equipements Electriques Moteur, Creteil (FR)

( * ) Notice: Subject to any disclaimer, the term of this patent is extended or adjusted under 35 U.S.C. 154(b) by 0 days.

(21) Appl. No.: 15/308,257

(22) PCT Filed: Apr. 22, 2015

(86) PCT No.: PCT/FR2015/051089

§ 371 (c)(1),
(2) Date: Nov. 1, 2016

(87) PCT Pub. No.: WO2015/170028

PCT Pub. Date: Nov. 12, 2015

(65) Prior Publication Data

US 2017/0053763 A1 Feb. 23, 2017

(30) Foreign Application Priority Data

May 5, 2014 (FR) ..... 14 54028

(51) Int. Cl.
*H01H 67/02* (2006.01)
*H01H 50/56* (2006.01)
(Continued)

(52) U.S. Cl.
CPC ..... *H01H 50/56* (2013.01); *H01H 1/2008* (2013.01); *H01H 50/20* (2013.01);
(Continued)

(58) Field of Classification Search
CPC ..... H01H 51/06; H01H 51/14; H01H 51/56; H01H 51/12; H01H 51/065; H01H 51/023
(Continued)

(56) References Cited

U.S. PATENT DOCUMENTS 3,815,060 A * 6/1974 Turnbull ..... H01H 50/546 335/131
4,604,597 A * 8/1986 Bogner ..... H01H 51/065 335/127
(Continued)

FOREIGN PATENT DOCUMENTS

DE 102012201967 A1 8/2013
FR 2906941 A1 4/2008
(Continued)

*Primary Examiner* — Shawki S Ismail
*Assistant Examiner* — Lisa Homza
(74) *Attorney, Agent, or Firm* — Berenato & White, LLC

(57) ABSTRACT

A contact device (15) of a starter contactor (1) comprising:—a contact rod (17) made of an electrically insulating material,—a contact strip (19) made of an electrically conducting material comprising a hole (19*a*) in which is mounted the contact rod (17),—a squashing spring (25),—a restoring spring (27), the contact device (15) also comprises a closure clip (33) of radial width greater than or equal to the diameter of the squashing spring (25), a radial notch (33*a*) being made in the closure clip (33), the radial notch (33*a*) receiving a portion of the contact rod (17), the squashing spring (25) being mounted compressed between the closure clip (33) and the contact strip (19) which is in abutment on a retaining collar (17*a*) of the contact rod (17).

19 Claims, 5 Drawing Sheets

(51) Int. Cl.

| | |
|---|---|
| ***H01H 1/20*** | (2006.01) |
| ***H01H 50/30*** | (2006.01) |
| ***H01H 51/06*** | (2006.01) |
| ***H01H 50/20*** | (2006.01) |

(52) U.S. Cl.
CPC ..... *H01H 50/30* (2013.01); *H01H 51/065* (2013.01); *H01H 2235/01* (2013.01)

(58) Field of Classification Search
USPC ..... 335/126
See application file for complete search history.

(56) References Cited

U.S. PATENT DOCUMENTS

| | | | | |
|---|---|---|---|---|
| 5,424,700 | A * | 6/1995 | Santarelli | H01H 1/06 335/126 |
| 5,892,422 | A * | 4/1999 | Montaigu | H01H 51/065 335/126 |
| 6,049,263 | A * | 4/2000 | Vilou | H01H 51/065 290/38 R |
| 7,199,687 | B2 * | 4/2007 | Maruhashi | F02N 15/063 335/131 |
| 8,928,436 | B2 * | 1/2015 | Hirabayashi | H01H 51/065 335/131 |
| 9,177,744 | B2 * | 11/2015 | Biessenberger | H01H 51/065 |

FOREIGN PATENT DOCUMENTS

| | | | | |
|---|---|---|---|---|
| FR | 2957711 | A1 | 9/2011 | |
| FR | 2957711 | B1 * | 10/2016 | H01H 51/065 |
| GB | 795336 | A | 5/1958 | |

* cited by examiner

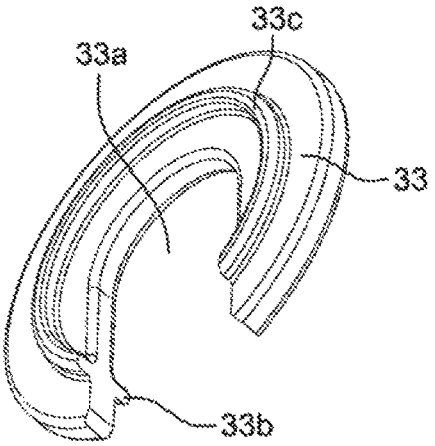
Fig. 4a
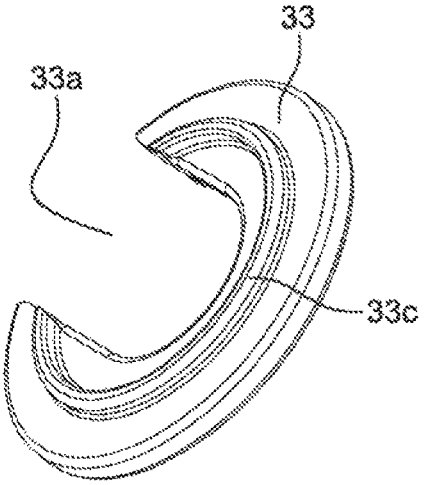
Fig. 4b
Fig. 4c
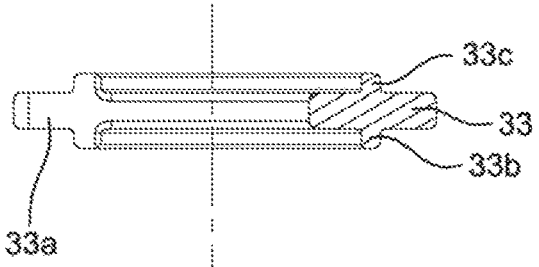
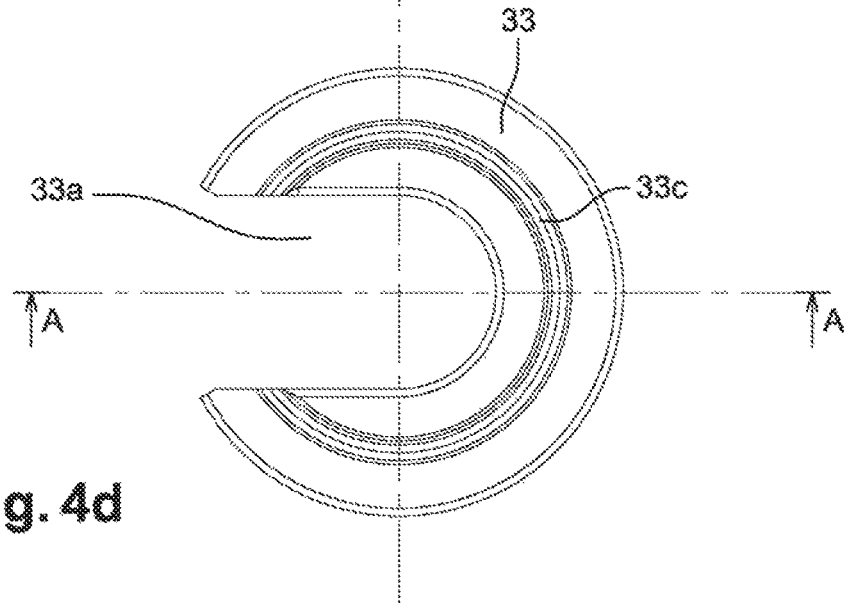
Fig. 4d

CONTACT DEVICE OF A STARTER CONTACTOR

CROSS-REFERENCE TO RELATED APPLICATIONS AND CLAIM TO PRIORITY

This application is a national stage application of International Application No. PCT/FR2015/051089 filed Apr. 22, 2015, which claims priority to French Patent Application No. 1454028 filed May 5, 2014, the disclosures of which are incorporated herein by reference and to which priority is claimed.

FIELD OF THE INVENTION

The present invention relates to the field of starters for thermal engines, in particular for motor vehicles, and more specifically the contactors of the starters which make possible the supply of power to the electric motor which drives the pinion of the starter.

BACKGROUND OF THE INVENTION

The contactors of the starters according to the prior art have two functions, firstly to displace the launcher which supports the pinion by means of a fork, such as to allow the pinion to engage on the crown of the thermal engine to be started, and secondly to supply power to the electric motor of the starter, thus making it possible to rotate the pinion. For this purpose, the contactors comprise a set of coils which make it possible to displace the mobile part of a magnetic core, with the mobile part of the magnetic core giving rise both to the displacement of the fork and the displacement of a contact device comprising a contact plate which is designed to establish an electrical contact between the supply terminals of the electric motor.

In addition, springs known as the compression spring and the return spring are placed on both sides of the plate, such as to constrain the plate against the terminals when the coils are activated and displace the plate towards the terminals, and to facilitate the return of the plate to the initial position when power is no longer supplied to the coils.

However, with the systems according to the prior art, the plate may rebound once or more on the terminals when power is supplied to the coils. This rebound/these rebounds give(s) rise to poor contact and disrupt(s) the functioning of the starter.

In addition, the contact devices according to the prior art generally comprise a large number of parts, which gives rise to complex assembly.

In particular, means for assembling a rod, springs and stops are known from patent application FR2957711. For example, in this patent application, assemblies exist with stops which are fitted on the rod in order to retain a compression spring. According to one embodiment, a washer of the bayonet type is described, fitted onto the contact rod. This embodiment makes it necessary to produce a shaft with a flattened shoulder and a groove. In addition, the production method is very complicated using a machine, since it is necessary to be able to index the washer relative to the shoulder, and turn the latter whilst exerting pressure on the compression spring.

This embodiment is thus complex to implement. Other embodiments described in order to solve this problem of complex fitting, as well as a rod without a shoulder. For example, an embodiment is described in which the assembly comprises a washer with claws fitted onto the contact rod, however with an embodiment of this type, with many cycles of use, as is the case for reinforced starters (i.e. a starter which starts a thermal engine which is switched off spontaneously when the vehicle stops, for example at a red light) which require a number of cycles four times greater than with a so-called standard starter, there is a risk that the washer with claws will break or withdraw towards the fixed core, leaving a gap relative to the compression spring, and thus giving rise to malfunctioning of the starter. In fact, in a case of this type, it may happen that the compression spring is no longer functional, and therefore no longer ensures the contact between the contact plate and the terminals. According to another embodiment of this document, an embodiment is described in which a pin is added in the shaft in order to retain a washer which forms the stop of the compression spring. However, an embodiment of this type is complex to implement because of the forced insertion into the shaft of a pin which may break during the assembly. Furthermore there are two parts to be assembled instead of one in comparison with the other embodiments, thus making the assembly more complex. In addition, an assembly of this type may not allow the contact rod to be supported on the fixed core. In fact, in an embodiment of this type, in the state of rest, it is the plate which is supported on the fixed core, which can cause it to become deformed.

In addition, in all of these embodiments, as well as in the prior art, the spring for compression of the plate against the terminals can become misaligned relative to the rod, thus giving rise to an imbalance of the forces of the spring on the plate against the terminals. This results in the risk of an arc between the plate and the terminal, since the plate is inclined, and therefore comes into contact with one terminal before the other terminal. These arcs give rise to premature wear of the plate.

SUMMARY OF THE INVENTION

The objective of the invention is thus to provide a solution which is inexpensive, and with simple assembly of the contact device which makes it possible to reduce the occurrence of rebounds when the coils are supplied with power and the plate is displaced towards the terminals. In addition, the contact device must be reliable in order to make it possible to retain the different elements in position, even after a large number of starting operations.

For this purpose, the subject of the present invention is a contact device of a starter contactor comprising:

- a contact rod made of electrically insulating material;
- a contact plate made of electrically conductive material comprising a hole in which the contact rod is fitted;
- a compression spring;
- a return spring, the contact device comprising a closure clip with a radial width which is larger than, or equal to, the outer diameter of the compression spring, a radial notch being provided in the said closure clip, the said notch receiving a portion of the contact rod, the compression spring being fitted compressed between the closure clip and the contact plate which abuts a collar for retention of the contact rod.

This therefore results in assembly which is easy to carry out with a single part of the closure clip fitted on the contact rod forming the stop of the compression spring. In fact, the insertion of the clip in a notch in the contact rod is far easier to carry out than centring a washer on the rod. This results in a lower production cost, and in feasibility with a lower risk of rejection than in the prior art. In addition, a clip of this type makes it possible to ensure that it is retained on the control rod throughout the service life of the starter, whilst being supported against a wall of the radial notch in the contact rod.

According to another aspect of the present invention, the closure clip abuts a closure collar of the contact rod.

This makes it possible to obtain better support of the clip against the control rod, and therefore to reduce the pivoting of the clip relative to the control rod, in order to obtain stable support for the compression spring.

According to an additional aspect of the present invention, the closure clip comprises a first peripheral centring edge which is configured to surround the closure collar at least partially such as to retain the closure clip in position around the contact rod.

This makes it possible to obtain centring of the clip around the axis of the contact rod, and thus to reduce the risk of part of the spring being supported on the clip.

According to an additional aspect of the present invention, the closure clip comprises a peripheral centring edge which is configured to be surrounded at least partially by the end of the compression spring, in order to keep the said compression spring centred around the contact rod. This makes it possible to keep the spring centred better on the contact rod.

According to an additional aspect, the closure clip comprises on each side two peripheral centring edges, one configured to be surrounded at least partially by the end of the compression spring, in order to keep the said compression spring centred around the contact rod, and one to surround the closure collar at least partially in order to keep the closure clip in position around the contact rod. This makes it possible to ensure good centring of the spring on the contact rod, in order to avoid contact for example between the spring and the fixed core. This also permits balanced support of the spring on the contact plate, therefore making it possible to reduce the wear of the contact plate by reducing the risks of arcs always on the same side of the contact plate.

According to an additional aspect, the closure clip is symmetrical. This makes it possible for it to be fitted in both directions in order to facilitate the fitting.

According to another aspect of the present invention, the closure collar is in a single piece with the contact rod.

According to an additional aspect of the present invention, the retention collar is in a single piece with the contact rod.

According to another aspect of the present invention, the compression spring is in contact with the contact plate.

According to an additional aspect of the present invention, the compression spring comprises a turn at the end of the compression spring which is in contact with the contact plate, this turn comprising a portion of flat surface perpendicular to the axis of revolution of the compression spring.

According to an additional aspect of the present invention, the closure clip and the contact plate apply a pre-stress of 45 N±10% on the compression spring.

According to another aspect of the present invention, the return spring is retained by friction around an end of the contact rod, and is supported on the retention collar.

According to an additional aspect of the present invention, the diameter of the hole in the contact plate is larger than the diameter of the closure collar and smaller than the diameter of the retention collar.

According to an additional aspect of the present invention, the compression spring has rigidity which is greater than that of the return spring.

The present invention also relates to a starter comprising a contact device.

According to another invention, the subject of which is a contact device of a starter contactor comprising:

a contact rod made of electrically insulating material;

a contact plate made of electrically conductive material comprising a hole in which the contact rod is fitted;

a compression spring;

a return spring, the contact device comprising a closure stop with a radial width which is larger than, or equal to, the outer diameter of the compression spring, the compression spring being fitted compressed between the closure stop and the contact plate which abuts a collar for retention of the contact rod, and being characterised in that the stop comprises a peripheral centring edge which extends axially, the peripheral centring edge being configured either to be surrounded at least partially by the end of the compression spring, in order to keep the said compression spring centred around the contact rod, or to surround the outer end of the spring.

This makes it possible to ensure the centring of the spring around the rod. The invention thus makes it possible to reduce the wear of the plate by electric arcs.

According to an aspect of the invention, the stop comprises two peripheral centring edges, one on each face of the stop. This makes it possible to fit the stop in any direction.

According to another aspect of the invention, the stop is a clip as previously described. This makes it possible to facilitate the assembly of the stop.

According to another embodiment of this invention, the stop is a stop which is fitted in bayonet form on the contact rod.

According to another embodiment of this invention, the stop is in a single piece with the contact rod. In this case, the assembly is carried out by putting firstly the compression spring, then the plate, then a stop which is fitted fixed in translation on the contact rod. According to one example, the stop ring is fitted in bayonet form on the rod, or by being clipped onto the contact rod.

The invention also relates to a starter comprising the assembly previously described.

BRIEF DESCRIPTION OF THE DRAWINGS

Other characteristics and advantages of the invention will become apparent from the following description provided with reference to the appended drawings which represent possible embodiments by way of non-limiting indication.

In these drawings:

FIGS. 4*a*, 4*b*, 4*c* and 4*d* represent diagrams of a closure clip according to a second embodiment of the present invention;

In these figures, the same reference numbers designate identical elements.

DETAILED DESCRIPTION OF THE PREFERRED EMBODIMENT(S)

Contactor 1

Figure 1A:
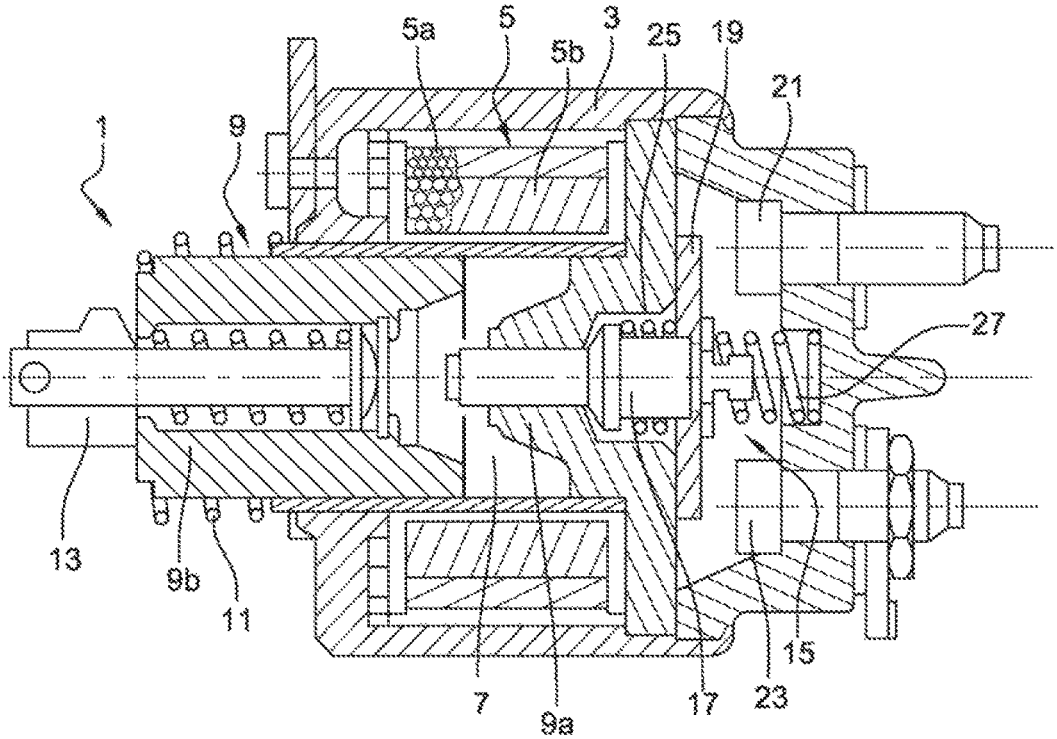
FIG. 1A represents a view in axial cross-section of a starter contactor according to an embodiment of the invention.
Figure 1B:
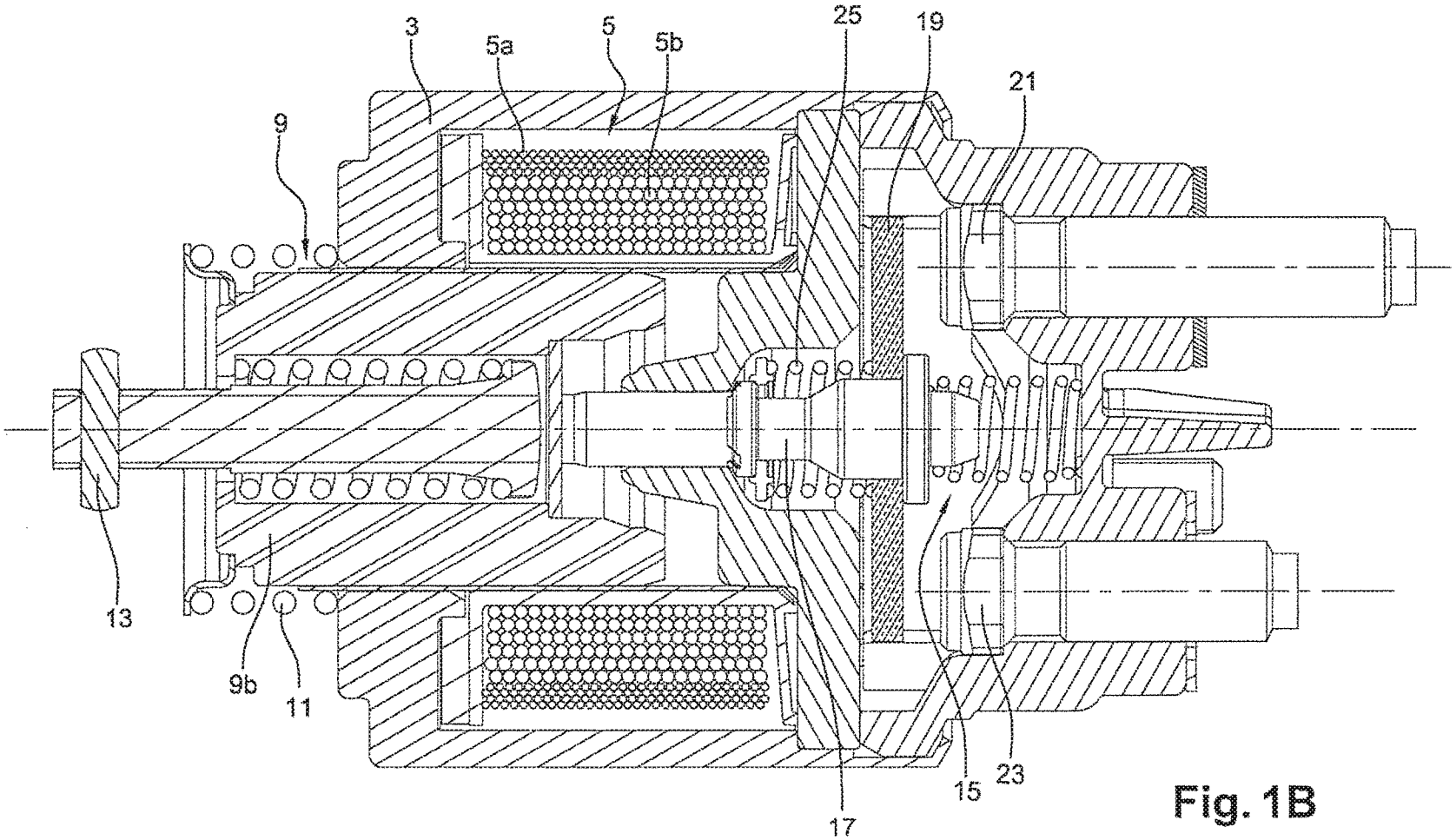
FIG. 1B represents a view in axial cross-section of a starter contactor according to another embodiment of the invention.

FIGS. 1A and 1B show a diagram of a starter contactor 1 comprising a cover 3 containing a set of coils 5. The set of coils 5 defines in its centre a tubular chamber 7 in which a magnetic core 9 is arranged. The magnetic core 9 comprises a fixed part 9*a* and a mobile part 9*b* which can be displaced in translation under the effect of the set of coils 5, between a position of rest represented in FIG. 1, and an active position in which the mobile part 9*b* comes into contact with the fixed part 9*a* of the magnetic core 9. A helical spring 11 assists the return to the position of rest in the absence of a supply of power to the set of coils 5. The set of coils 5 comprises a pull-in coil 5*a* and a contact coil 5*b*, the two coils 5*a* and 5*b* being supplied with power in order to displace the mobile part 9*b* of the magnetic core 9 from its position of rest to its active position, then the mobile part 9*b* is retained in the active position by the contact coil 5*b* alone, such as to limit the consumption of the set of coils 5.

The mobile part 9*b* of the magnetic core 9 is connected to a fork 13 (represented partially) which drives the displacement of a pinion launcher (not represented) of the starter towards the crown (not represented) of the thermal engine to be started, when the mobile part 9*b* of the magnetic core 9 is displaced towards its active position.

In addition, the displacement of the mobile part 9*b* of the magnetic core 9 to the active position gives rise to the displacement in translation relative to the cover 3 of a contact rod 17 of a contact device 15, between a position of rest represented in FIG. 1, and an active position. The contact device 15 comprises a contact rod 17 provided with a retention collar 17*a* which is integral in translation with the contact rod 17, and a contact plate 19 fitted on the contact rod 17. The passage to the active position of the contact rod 17 gives rise to putting into contact of the contact plate 19 with at least one electrical terminal. In the present case, the contact plate 19 comes into contact with two electrical terminals 21 and 23, in order to supply power to the electric motor (not represented) thus giving rise to rotation of the pinion. In addition, the contact plate 19 is mobile relative to the contact rod 17, between an initial position in which the contact rod 17 is in a position of rest, and a final position in which the contact rod 17 is in the active position. In the initial position, the contact plate 19 is in contact with the retention collar 17*a*, and in the final position, a gap is formed between the retention collar 17*a* and the contact plate 19 because of the contact with the electrical terminals 21 and 23.

The contact device 15 also comprises a compression spring 25 fitted on the contact rod 17, which is positioned around a portion of the contact rod 17, and is designed to be compressed when the contact plate 19 comes into contact with the electrical terminals 21 and 23, and a return spring 27 which is designed to facilitate the return of the contact device 15 to the position of rest when power is no longer supplied to the coils 5*a* and 5*b*.

In the embodiment in FIG. 1A, in the position of rest the plate is in contact with the fixed core.

In the embodiment in FIG. 1B, in the position of rest the plate is not in contact with the fixed core, but it is the stop 17B which is in contact with the fixed core. This makes it possible to prevent the plate from being deformed when the spring 25 shown in FIG. 2 thrusts the plate towards the position of rest.

Contact Device 15

The contact device will now be described in detail on the basis of FIG. 2.

Figure 2:
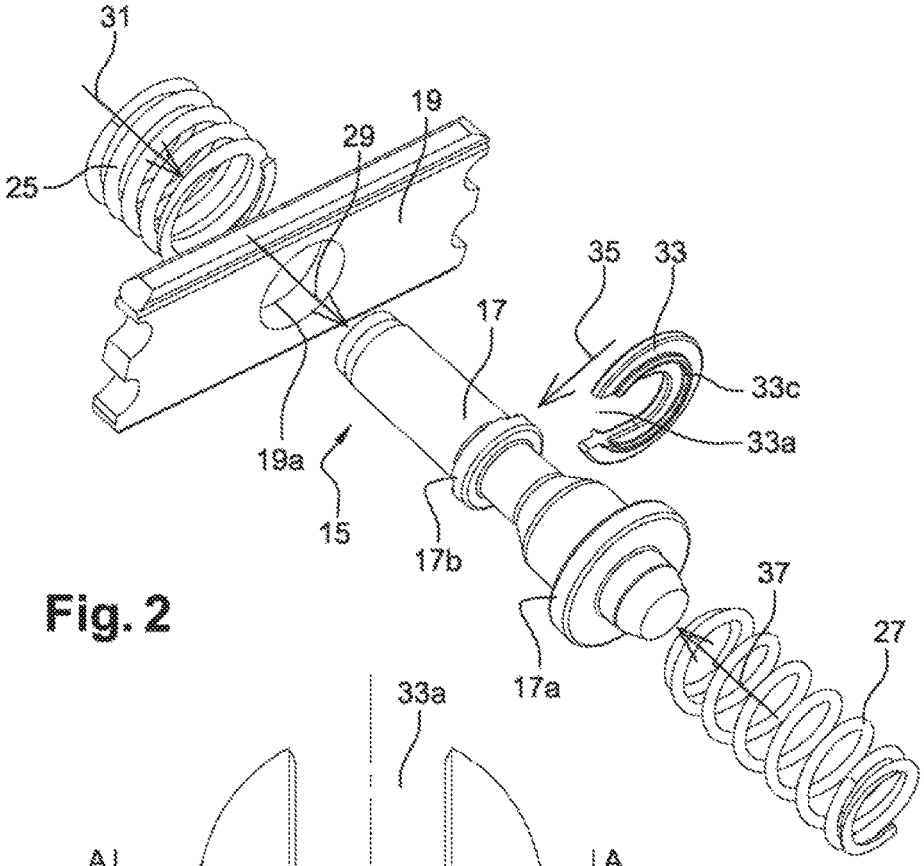
FIG. 2 represents an exploded view of a contact device according to the present invention.
Figure 3A:
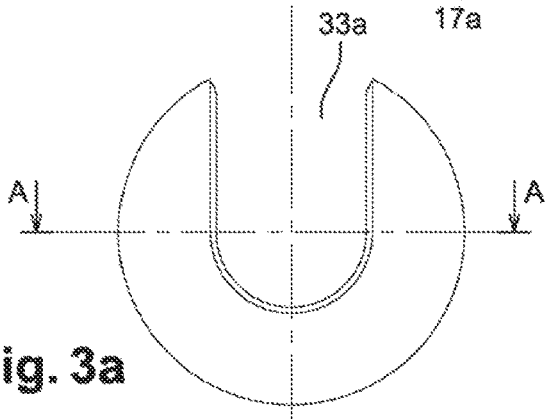
FIGS. 3*a*, 3*b*, 3*c*, 3*d* represent a diagram of a closure clip according to a first embodiment of the present invention.
Figure 3B:
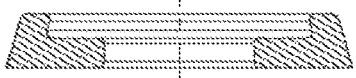
Figure 3C:
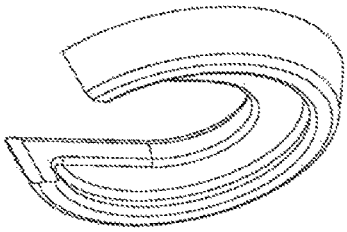
Figure 3D:
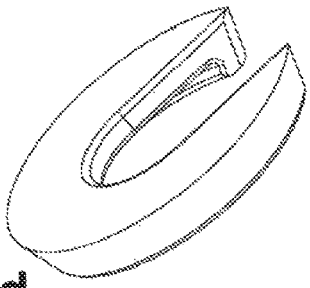

FIG. 2 represents an exploded view of a contact device 15 according to the invention. The contact device comprises a contact rod 17 made of electrically insulating material, for example polymer material. The contact rod 17 comprises a first radial surface forming a retention collar 17*a* with a first diameter, and a second radial surface forming a collar 17*b* for closure of a second diameter which is smaller than the first diameter. The retention 17*a* and closure 17*b* collars are in a single piece with the contact rod 17, i.e. they are integral with the contact rod 17. The contact plate 19 is made of conductive material, for example copper, and comprises a circular central hole 19*a*, the diameter of which is larger than the diameter of the closure collar 17*b* and smaller than the diameter of the retention collar 17*a*.

Thus, the contact plate is fitted on the contact rod 17 by inserting the contact rod 17 in the hole 19*a* in the contact plate 19, as indicated by the arrow 29. The contact plate 19 then comes into contact with the retention collar 17*a* of a first side of the retention collar 17*a*. The width of the plate is substantially equal to the diameter of the retention collar 17*a*, such that the retention collar 17*a* covers substantially the width of the contact plate 19, which contributes to the stability of the contact plate 19. The compression spring 25, the diameter of which is larger than the diameter of the hole 19*a* in the contact plate 19, is positioned around the contact rod 17, and comes into contact with the contact plate 17 as indicated by the arrow 31.

The compression spring 25 comprises at least one turn at its end, a portion of which comprises a flat surface perpendicular to the axis of revolution of the compression spring 25. This flat surface is obtained for example by grinding at the end of the spring in contact with the contact plate 17, such as to obtain a flat surface at the end of the compression spring 25, and increase the area of contact between the compression spring 25 and the contact plate 17, and thus improve the stability of the contact plate 17, in particular during the passage of the contact rod 17 into the active position. The contact device 15 also comprises a closure clip 33, the radial width of which is larger than, or equal to, the diameter of the compression spring 25, and in which a radial notch 33*a* is provided, the width of which is smaller than the diameter of the closure collar 17*b*, and is designed to receive a portion of the contact rod 17.

The closure clip 33 is positioned around the contact rod 17, against the radial surface formed by the closure collar 17*b*, as represented by the arrow 35. The closure clip thus comes between the compression spring 25 and the closure collar 17*b*, such as to retain the compression spring 25 and the contact plate 19 in position on the contact rod 17.

The closure clip 33 is thus fitted on the contact rod 17 after the contact plate 19 and the compression spring 25, the fitting of the closure clip 33 requiring compression of the compression spring 25 in order to be fitted on the contact rod 17.

The closure clip 33 then applies pre-stressing on the compression spring 25, which then applies a force on the contact plate 19 in the direction of the retention collar 17*a*, which contributes towards keeping the contact plate 19 supported to the maximum on the retention collar 17*a*. The compression spring 25 can also comprise a turn comprising a flat portion perpendicular to the axis of revolution of the compression spring 25 at its second end in contact with the closure clip 33, such as to increase the contact surface between the compression spring 25 and the closure clip 33.

The return spring 27 is positioned on the contact rod, supported on a second side of the retention collar opposite the first side, as indicated by the arrow 37. The inner diameter of the return spring 27 is slightly smaller than, or substantially equal to, the diameter of the end of the contact rod 17 which is designed to receive the return spring 27, such that the friction between the return spring 27 and the contact rod 17 makes it possible to keep the return spring 27 in position on the contact rod 17, in particular before it is fitted in the contactor 1.

As for the compression spring 25, the return spring 27 can comprise, at one of its ends at least, a turn comprising a flat portion perpendicular to the axis of revolution of the return spring 27, such as to obtain an end with a flat surface, and to maximise the surface of contact with the retention collar 17*a* on the one hand and the cover 3 of the contactor 1 on the other.

Closure Clip 33

The closure clip will now be described in greater detail on the basis of FIGS. 3*a*, 3*b*, 3*c*, 3*d*, 4*a*, 4*b*, 4*c*, 4*d* and 5.

In order to ensure the centring and retention in position of the closure clip 33, the latter comprises a peripheral centring edge 33*b* on its face which is designed to come into contact with the closure collar 17*b*, as represented in FIGS. 3*a*, 3*b*, 3*c*, 3*d*, the peripheral centring edge 33*b* having a diameter slightly larger than the diameter of the closure collar 17*b*, such as to be positioned around the latter, whilst leaving a minimum gap between the two. The closure clip 33 thus surrounds the closure collar 17*b* at least partially.

According to an alternative embodiment shown in FIGS. 4*a*, 4*b*, 4*c*, 4*d*, the closure clip 33 comprises a second peripheral centring edge 33*c* on its second face which is designed to be in contact with the compression spring 25, with the second peripheral centring edge 33*c* having a diameter which is slightly larger than the diameter of the compression spring 25, such as to surround the end of the compression spring 25 at least partially, whilst limiting the gap between the latter and the closure clip 33. This second peripheral centring edge 33*c* makes it possible to retain the compression spring 25 in a position centred around the contact rod 17. The two peripheral centring edges 33*b* and 33*c* can be different, for example in the case when the diameter of the compression spring 25 and of the closure collar 17*b* are different, but can also be identical in the case when the diameter of the compression spring 25 and the closure collar 17*b* are substantially identical, such as to facilitate the production of the closure clip 33, and reduce the production costs.

Figure 5:
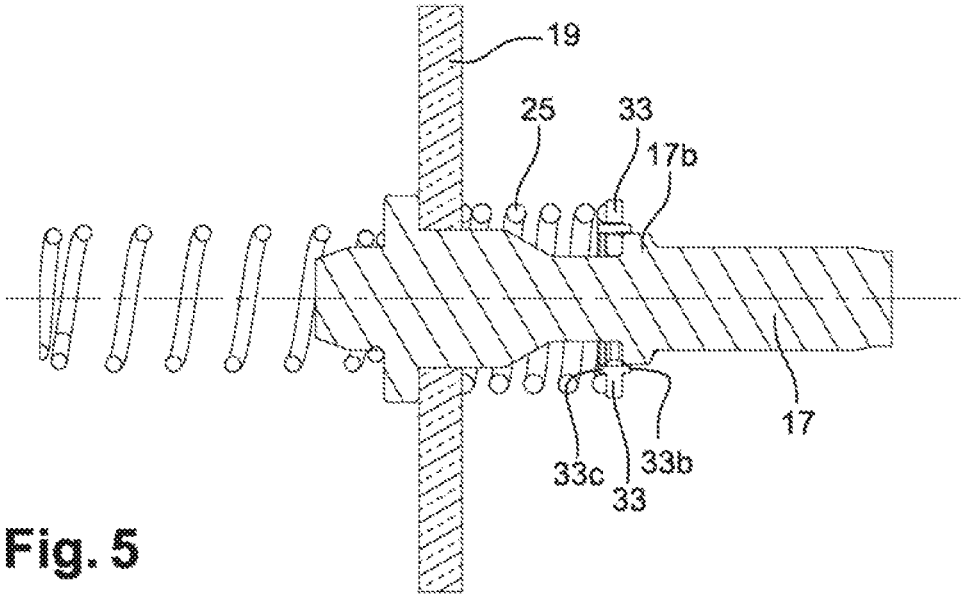
FIG. 5 represents a cross-section of the contact device according to the invention in the assembled state.

FIG. 5 represents a cross-section of the device, the closure clip 33 of which is, according to the embodiment in FIGS. 4*a* to 4*d*, in the state in which it is fitted on the contact rod 17. The first peripheral centring edge 33*b* is positioned around the closure collar 17*b*, and the second peripheral centring edge 33*c* is positioned in the centre of the compression spring 25, thus permitting retention and centring of the compression spring 25 around the contact rod 17.

Compression Spring 25 and Return Spring 27

Figure 6:
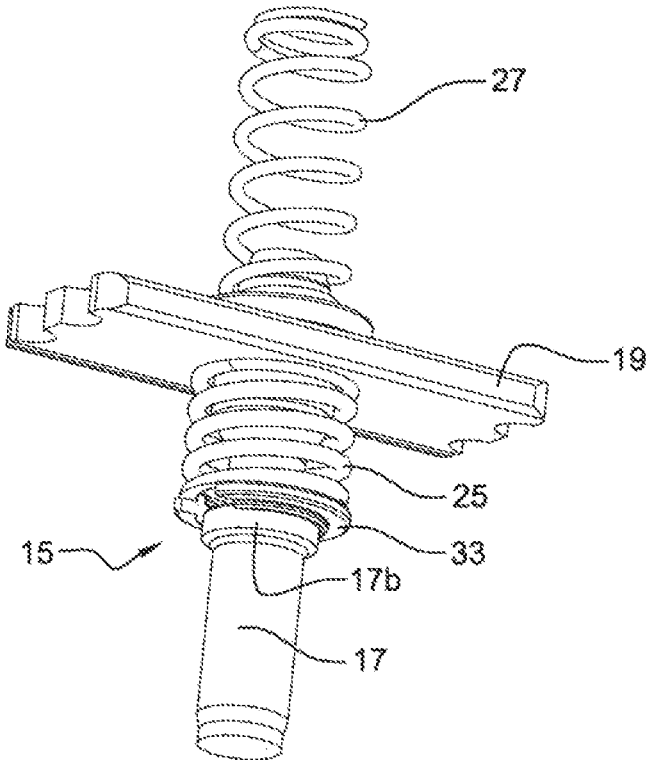
FIG. 6 represents a figure of a contact device according to the invention in the assembled state.

The compression 25 and return 27 springs are helical springs which are generally made of metal, for example steel. In the present invention, the rigidity of the compression spring 25 is greater than the rigidity of the return spring 27. In addition, the compression spring 25 is compressed between the contact plate 19 and the closure clip 33, such that, in the state of rest of the contact device 15, a pre-stress of between 40 N and 50 N is applied to the compression spring 25. FIG. 6 represents a figure of the contact device 15 in the assembled state. This contact device 15 comprises only five parts, i.e. the contact rod 17, the return spring 27, the contact plate 19, the compression spring 25 and the closure clip 33. This small number of parts makes it possible to reduce the cost of the device and make the assembly simpler and faster, which also makes it possible to reduce the assembly costs.

As previously described, in operation, the power supply to the set of coils 5 thus gives rise to the displacement of the contact rod into the active position, which gives rise to putting into contact of the contact plate with the electrical terminals 21 and 23. At this moment, the compression spring 25 applies a force to the contact plate 19 which is at least 20 N more than the force exerted by the return spring 27 on the contact rod 17, because of the difference in rigidity between the compression spring 25 and the return spring 27. The force exerted by the return spring 27 on the contact rod 17 is contained in an interval ranging from 25 to 40 N. The force exerted by the compression spring 25 on the contact plate 19 is for example 51 N, whereas the force exerted by the return spring 27 on the contact rod 17 is 28 N. This greater force of the compression spring 25 compared with the return spring 27 makes it possible to limit the gap formed between the contact plate 19 and the retention collar 17*a* in the final position of the contact plate 19, i.e. at the moment of the contact with the electrical terminals 21 and 23. The rebound to which the contact plate 19 is subjected is thus reduced during the passage into the active position of the contact rod 17, such that power is supplied to the electric motor without any poor contacts. In addition, when power is no longer supplied to the coils 5*a* and 5*b* of the set of coils 5, the return spring 27 makes it possible to disconnect the contact plate 19 from the electrical terminals 21 and 25, such as to permit the return of the contact plate 17 to the position of rest.

Thus, the use of a compression spring 25 with a large diameter, a large number of turns, a turn comprising a flat portion perpendicular to its axis of revolution at one of its ends at least, and the rigidity of which is greater than the rigidity of the return spring 27, makes it possible to obtain a contact device which is more stable during the passage from the position of rest to the active position, when the contact plate 19 comes into contact with the electrical terminals 21 and 23, thus making it possible to reduce greatly, or even eliminate, the rebound effect caused by the contact plate 19 approaching the electrical terminals 21 and 23, or due to the balancing of the compression spring 25 after this approach.

The contact device 15 according to the present invention thus makes it possible, by means of its structure and its reduced number of parts, to obtain a contact device 15 which is reliable in the long term, with a reduced production cost, and which reduces or eliminates the rebound effect during the activation of the contactor 1.

The invention claimed is:

1. A contact device (15) of a starter contactor (1), comprising:

- a contact rod (17) made of electrically insulating material, the contact rod (17) having a retention collar (17*a*);
- a contact plate (19) made of electrically conductive material comprising a hole (19*a*) in which the contact rod (17) is fitted;
- a compression spring (25);
- a return spring (27) having a rigidity lesser than the rigidity of the compression spring (25); and a closure clip (33) having a radial width larger than or equal to an outer diameter of the compression spring (25), the closure clip (33) having a radial notch (33*a*) receiving a portion of the contact rod (17), the compression spring (25) being fitted compressed between the closure clip (33) and the contact plate (19) abutting the retention collar (17*a*) for retention of the contact rod (17).

2. The contact device (15) according to claim 1, wherein the contact rod (17) comprises a closure collar (17*b*), and wherein the closure clip (33) abuts the closure collar (17*b*) of the contact rod (17).

3. The contact device (15) according to claim 2, wherein the closure collar (17*b*) is in a single piece with the contact rod (17).

4. The contact device according to claim 3, wherein the retention collar (17*a*) is in a single piece with the contact rod (17).

5. The contact device (15) according to claim 2, wherein the closure collar (17*b*) is in a single piece with the contact rod (17).

6. The contact device according to claim 2, wherein the retention collar (17*a*) is in a single piece with the contact rod (17).

7. The contact device according to claim 1, wherein the retention collar (17*a*) is in a single piece with the contact rod (17).

8. The contact device (15) according to claim 1, wherein the compression spring (25) is in contact with the contact plate (19).

9. The contact device (15) according to claim 8, wherein the compression spring (25) comprises a turn at the end of the compression spring which is in contact with the contact plate (19), this turn comprising a portion of flat surface perpendicular to the axis of revolution of the compression spring (25).

10. The contact device (15) according to claim 1, wherein the return spring (27) is retained by friction around an end of the contact rod (17), and is supported on the retention collar (17*a*).

11. A starter comprising a contact device (15) according to claim 1.

12. A contact device (15) of a starter contactor (1), comprising:

a contact rod (17) made of electrically insulating material, the contact rod (17) having a retention collar (17*a*) and a closure collar (17*b*);

a contact plate (19) made of electrically conductive material comprising a hole (19*a*) in which the contact rod (17) is fitted;

a compression spring (25);

a return spring (27); and a closure clip (33) having a radial width larger than or equal to an outer diameter of the compression spring (25), the closure clip (33) having a radial notch (33*a*) receiving a portion of the contact rod (17);

the compression spring (25) being fitted compressed between the closure clip (33) and the contact plate (19) abutting the retention collar (17*a*) for retention of the contact rod (17);

the closure clip (33) abutting the closure collar (17*b*) of the contact rod (17);

the closure clip (33) comprising a first peripheral centering edge (33*b*) configured to surround the closure collar (17*b*) at least partially to retain the closure clip (33) in position around the contact rod (17).

13. The contact device (15) according to claim 12, wherein the closure clip (33) comprises a second peripheral centring edge (33*c* ) which is configured to be surrounded at least partially by the end of the compression spring (25), in order to keep said compression spring (25) centred around the contact rod (17).

14. The contact device (15) according to claim 13, wherein the closure collar (17*b*) is in a single piece with the contact rod (17).

15. The contact device according to claim 13, wherein the retention collar (17*a*) is in a single piece with the contact rod (17).

16. The contact device (15) according to claim 12, wherein the closure collar (17*b*) is in a single piece with the contact rod (17).

17. The contact device according to claim 12, wherein the retention collar (17*a*) is in a single piece with the contact rod (17).

18. A contact device (15) of a starter contactor (1), comprising:

a contact rod (17) made of electrically insulating material, the contact rod (17) having a retention collar (17*a*);

a contact plate (19) made of electrically conductive material comprising a hole (19*a*) in which the contact rod (17) is fitted;

a compression spring (25);

a return spring (27); and a closure clip (33) having a radial width larger than or equal to an outer diameter of the compression spring (25), the closure clip (33) having a radial notch (33*a*) receiving a portion of the contact rod (17);

the compression spring (25) being fitted compressed between the closure clip (33) and the contact plate (19) abutting the retention collar (17*a*) for retention of the contact rod (17);

the closure clip (33) and the contact plate (19) applying a pre-stress of 45 N ±10% on the compression spring (25).

19. A contact device (15) of a starter contactor (1), comprising:

a contact rod (17) made of electrically insulating material, the contact rod (17) having a retention collar (17*a*) and a closure collar (17*b*);

a contact plate (19) made of electrically conductive material comprising a hole (19*a*) in which the contact rod (17) is fitted;

a compression spring (25);

a return spring (27); and a closure clip (33) having a radial width larger than or equal to an outer diameter of the compression spring (25), the closure clip (33) having a radial notch (33*a*) receiving a portion of the contact rod (17);

the compression spring (25) being fitted compressed between the closure clip (33) and the contact plate (19) abutting the retention collar (17*a*) for retention of the contact rod (17);

a diameter of the hole (19*a*) in the contact plate (19) being larger than the diameter of the closure collar (17*b*) and smaller than the diameter of the retention collar (17*a*).

* * * * *